US006603943B2

(12) United States Patent
Yuuki et al.

(10) Patent No.: US 6,603,943 B2
(45) Date of Patent: Aug. 5, 2003

(54) DEVELOPING APPARATUS INCLUDING FIRST AND SECOND AGITATING MEMBERS IN WHICH THE FIRST AGITATING MEMBER INCLUDES NON-SCREW PORTION

(75) Inventors: Kazuhiko Yuuki, Tokyo (JP); Yoshinori Ozawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/984,689

(22) Filed: Oct. 31, 2001

(65) Prior Publication Data

US 2002/0051657 A1 May 2, 2002

(30) Foreign Application Priority Data

Oct. 31, 2000 (JP) ..... 2000-332329

(51) Int. Cl.[7] ..... G03G 15/08
(52) U.S. Cl. ..... 399/256; 399/254
(58) Field of Search ..... 399/254, 255, 399/256, 258, 263; 366/291, 297

(56) References Cited

U.S. PATENT DOCUMENTS 3,999,514 A * 12/1976 Abbott et al. ..... 399/256
4,173,405 A * 11/1979 Swapceinski et al. ..... 399/256
5,264,900 A * 11/1993 Momiyama et al. ..... 399/256
5,495,320 A 2/1996 Araki et al.
5,864,733 A 1/1999 Mae et al.
5,963,766 A 10/1999 Okuno et al.
6,122,472 A * 9/2000 Sako et al. ..... 399/254
6,141,521 A 10/2000 Yuuki et al.
6,249,664 B1 * 6/2001 Sato ..... 399/256
6,324,369 B1 * 11/2001 Yamaguchi et al. ..... 399/254
6,415,125 B1 * 7/2002 Yamamoto et al. ..... 399/254

OTHER PUBLICATIONS

Patent Abstracts of Japan, JP 10–010852, Jan. 16, 1998.
Patent Abstracts of Japan, JP 9–120201, May 6, 1997.

* cited by examiner

*Primary Examiner*—Sandra Brase
(74) *Attorney, Agent, or Firm*—Oblon, Spivak, McClelland, Maier & Neustadt, P.C.

(57) ABSTRACT

In a developing apparatus, the interior of a case is divided into a first space positioned on a developer supply side for the supply of a developer to an image bearing member and a second space which is supplied with a replenishing toner, first and second agitating members are included and are adapted to be rotated to agitate and convey the developer are disposed within the first and second spaces, respectively, and a screw member is provided having n threads (n≧2) is used as the first agitating member disposed in the first space, and a screw member having (n−x) threads (x≧0) is used as the second agitating member disposed in the second space.

11 Claims, 6 Drawing Sheets

DEVELOPING APPARATUS INCLUDING FIRST AND SECOND AGITATING MEMBERS IN WHICH THE FIRST AGITATING MEMBER INCLUDES NON-SCREW PORTION

BACKGROUND OF THE INVENTION

1. Field of the Invention

The present invention relates to a developing apparatus wherein a developer is conveyed while being agitated by screw-like agitating members having different numbers of threads, as well as an image formation apparatus using the developing apparatus.

2. Description of the Prior Art

In an image formation apparatus, using a developing apparatus which serves as a developer supply means, a developer is fed to an electrostatic latent image formed on an image bearing member to develop the electrostatic latent image. In a developing apparatus using a two-component developer comprising a carrier and a toner, it is desirable that the toner and the carrier be conveyed in a satisfactorily agitated state. In view of this point, there has been proposed a developing apparatus of a twin screw agitating type wherein the interior of a case is divided by a partition wall into a first space positioned on a toner supply side for the image bearing member and a second space into which is fed a replenishing toner, with screw-like agitating members being disposed in parallel within the spaces.

According to the developing apparatus of a twin screw agitating type, a developer is conveyed while being agitated by a first agitating member disposed in the first space and a second agitating member disposed in the second space and the developer thus conveyed is fed into the spaces from delivery portions formed at end portions of the agitating members, thus being circulated. In such a twin screw agitating type developing apparatus, a screw trace, which is caused by, for example, unevenness in the density of the screw pitch, is apt to occur at the time of development of an image having a high image ratio. Therefore, attempts have been made to agitate and convey a developer by using multiple-thread screws as the first and second agitating members.

With such multiple-thread screws as the first and second agitating members, there occurs a new problem although the occurrence of screw traces can he prevented. For attaining a satisfactory development in the twin screw agitating type developing apparatus, it is important that a sufficient developer be fed to the first space having the first agitating member. However, if the multiple-thread screws are used as agitating members, the area occupied by the screws in each space is large and the amount of developer loaded into the developing apparatus becomes smaller, resulting in decrease of the amount of developer fed to the first space positioned on the toner supply side.

If agitating members are screws having an identical number of threads and an identical pitch, it is theoretically possible to convey an identical amount of developer at an identical speed. However, if the screws have areas too large with respect to the aforementioned spaces, the developer becomes more bulky and the agitating members are buried in the developer. If such a state occurs, there is formed an area on which each of the agitating members cannot exhibit its conveying force. This causes a difference in the developer conveying speed as compared with the case where the agitating members are not buried. As a result, the developer circulating balance is lost and the developer stays in the end portions of the spaces.

Even at the same conveying speed, if agitating members have different numbers of threads, i.e., different numbers of blades, the screw having a larger number of threads conveys less developer. For example, if the second agitating member has a smaller number of threads and the first agitating member has a larger number of threads, the developer will stay in the vicinity of a developer delivery portion for delivery of developer from the second space having the second agitating member to the first space having the first agitating member. If the delivery portion with the developer thus staying therein overlaps an image forming area, a larger amount of developer than necessary is fed into the first space and the developer may leak out of the apparatus from near a portion opposed to the image bearing member.

A certain developing apparatus is provided with a toner concentration detecting means for detecting and outputting a toner concentration in a developer. However, if the way in which the developer stays within a space changes, a greater output difference results, disabling to accurately detect a toner concentration.

SUMMARY OF THE INVENTION

It is an object of the present invention to provide a developing apparatus and an image formation apparatus in which the occurrence of screw pitch traces and unsatisfactory development caused by an insufficient amount of developer fed are extremely diminished It is another object of the present invention to provide a developing apparatus and an image formation apparatus capable of preventing leakage of a developer to the exterior of the apparatus.

It is a further object of the present invention to provide a developing apparatus and an image forming apparatus capable of detecting a toner concentration accurately even if there is a change in the way of staying of a developer.

For achieving the above-mentioned objects, the present invention provides a developing apparatus comprising: a case divided into a first space located at a developer supply side for supplying the developer to an image bearing member and a second space for receiving a replenishing toner; a first and a second agitating member arranged in the first and the second spaces in such a manner that the first and the second agitating members are positioned parallel to each other and are driven to rotate to agitate and convey the developer, wherein the first agitating member arranged in the first space is a screw member having n threads ($n \geqq 2$), and the second agitating member arranged in the second space is a screw member having (n−x) threads ($x \geqq 0$). Since the second agitating member has a smaller number of threads than the first agitating member, the volume thereof in the second space decreases and the bulk (height) of the developer is prevented from becoming larger.

The developing apparatus may further comprise: a first delivery portion for feeding the developer from the first space into the second space; and a second delivery portion for feeding the developer from the second space into the first space, which secondary delivery portion is positioned outside an image formation area of the image bearing member. According to this construction, the position where the developer is delivered from the second space to the first space lies exteriorly of the image forming area of the image bearing member, with no delivery of the developer within the image forming area.

For diminishing the developer conveying capacity of the second agitating member, a non-screw portion may be formed at a portion of the second agitating member located at a predetermined interval in the convey direction of the developer conveyed by the second agitating member, thereby suppressing the convey force.

Likewise, for diminishing the developer conveying capacity of the second agitating member, rotation speed $V_1$ of the first agitating member is set greater than rotation speed $V_2$ of the second agitating member. This relation can be established by rotating the first and second agitating members each individually with use of different drive sources for rotation or, in case of using a single drive source for rotation, with use of gears having a different number of teeth or pulleys different in speed change ratio in an integrally rotatable manner with the first and second agitating members. As a result, the amount of developer conveyed per unit time by the second agitating member is kept smaller than that by the first agitating member.

Further, for diminishing the developer conveying capacity of the second agitating member, it is preferable to narrow the screw pitch of the second agitating member. This is also effective because the amount of developer conveyed per unit time decreases.

In the case where the developing apparatus includes toner concentration detecting means to detect and output the concentration of toner contained in the developer, the toner concentration detecting means having a detection surface which faces the interior of the second space, it is preferable that the toner concentration detecting means be disposed closer to the first delivery portion than to the second delivery portion with respect to the center of the image forming area. According to this construction, even if the way of staying of the developer changes on the second delivery portion side, this can be made less influential on the toner concentration detecting means.

According to another aspect of the present invention, there is provided an image forming apparatus having an image bearing member and developer supply means for supplying a developer to an electrostatic latent image formed on the image bearing member to develop the electrostatic latent image, wherein a developing apparatus is used as the developer supply means, the developing apparatus having a screw member of n threads ($n \geqq 2$) as a first agitating member disposed within a first space and a screw member of (n−x) threads ($x \geqq 0$) as a second agitating member disposed within a second space to receive the supply of a replenishing toner. According to this construction, since the number of threads of the second agitating member is smaller than that of the first agitating member, the volume of the second agitating member in the second space decreases.

In case of using as the developer supply means a developing apparatus having a first delivery portion for feeding the developer from the first space to the second space and a second delivery portion for feeding the developer from the second space to the first space, the second delivery portion being positioned on an outer side with respect to an image forming area of the image bearing member, the position where the developer is delivered from the second space to the first space lies exteriorly of the image forming area of the image bearing member, with no delivery of the developer within the image forming area.

In case of using a developing apparatus as the developing supply means, the developing apparatus having non-screw portion at a portion of the second agitating member which portion is positioned in a predetermined section in the direction of conveyance of the developer conveyed by the second agitating member, the developer conveying capacity of the second agitating member is kept low by the non-screw portion.

In case of using as the developer supply means a developing apparatus wherein if the rotational speed of the first agitating member is $V_1$ and that of the second agitating member is $V_2$, there is established a relation of $V_1 > V_2$, the developer conveying capacity of the second agitating member decreases.

In case of using as the developer supply means a developing apparatus wherein the screw pitch of the second agitating member is set narrow, the amount of the developer fed per unit time decreases.

Further, as the developer supply means there may be used a developing apparatus including a toner concentration detecting means for detecting and outputting the concentration of toner contained in the developer, the toner concentration detecting means having a detection surface which faces the interior of the second space and being disposed closer to the first delivery portion rather than the second delivery portion with respect to the center of the image forming area. In this case, even if the way of staying of the developer changes on the second delivery portion side, this can be made less influential on the toner concentration detecting means.

DETAILED DESCRIPTION OF PREFERRED EMBODIMENTS

Figure 2:
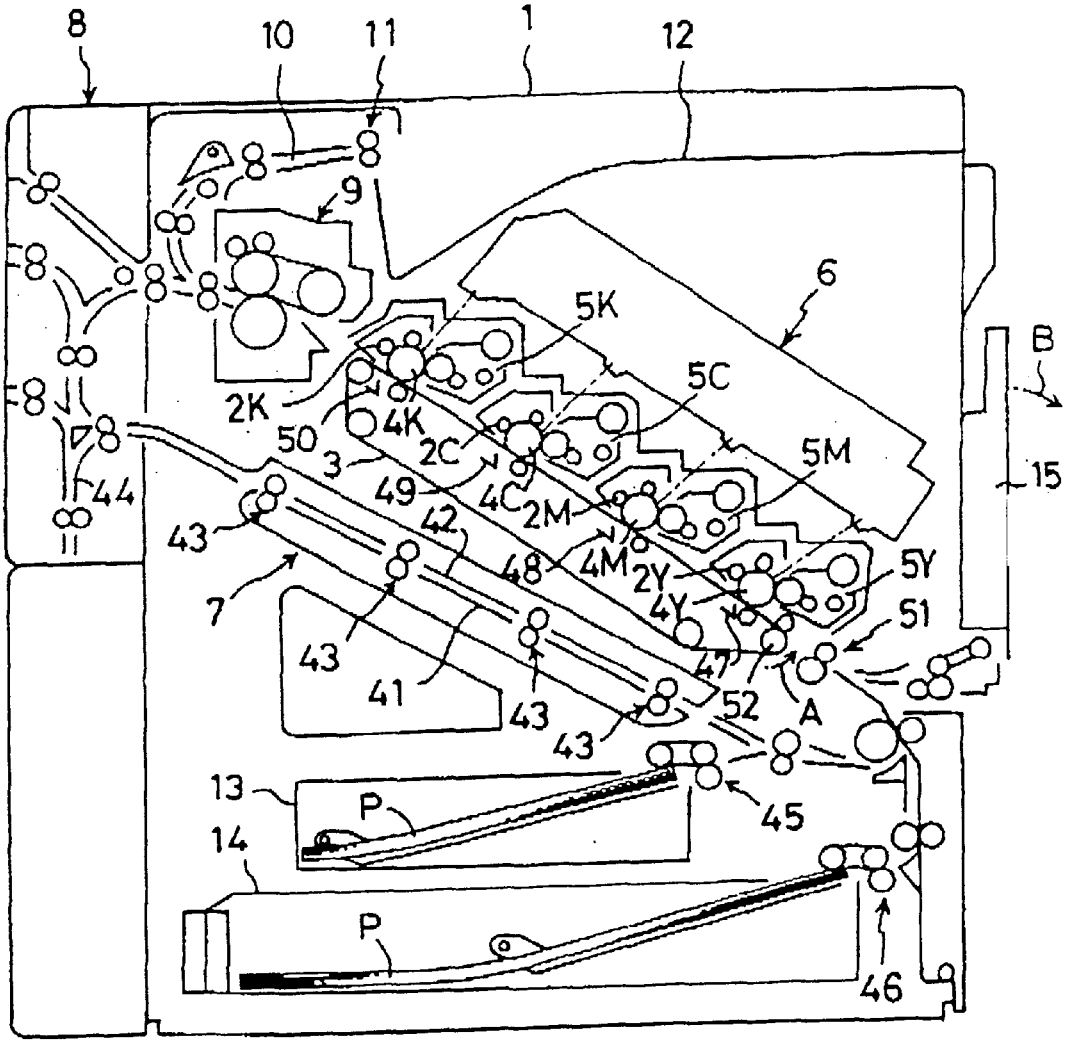
FIG. 2 is an entire construction diagram showing one mode of an image formation apparatus which uses the developing apparatus as a developer supply means.

Embodiments of the present invention will now be described. FIG. 2 illustrates a full-color printer of an electrophotographic type as an image formation apparatus according to the present invention. In FIG. 2, a plurality of photosensitive units 2Y, 2M, 2C, and 2K as image bearing units are detachably loaded into a box-like apparatus body 1. A transfer belt 3 as a recording medium carrier is disposed approximately at the center of the apparatus body 1 and obliquely in a diagonal direction of the apparatus body 1. The transfer belt 3 is entrained on a plurality of rollers, to one of which rotation force is transmitted, so that the belt 3 can be rotated in a direction indicated with arrow A.

The photosensitive units 2Y, 2M, 2C, and 2K have drum-like photosensitive elements 4Y, 4M, 4C, and 4K, respectively, as image bearing members and are arranged above the transfer belt 3 in such a manner that surfaces of the photosensitive elements come into contact with the transfer belt 3, The photosensitive units 2Y, 2M, 2C, and 2K are arranged in the order of the respective receptors 4Y, 4M, 4C, and 4K so that the photosensitive units 2Y and 2K are positioned on a paper feed side and a fixing device 9 side, respectively. As the photosensitive elements 4Y, 4M, 4C, and 4K there may be used belt-like photosensitive elements.

Developing units 5Y, 5M, 5C, and 5K serving as developer supply means are disposed in opposition to the photosensitive elements 4Y, 4M, 4C, and 4K, respectively. In the developing units 5Y, 5M, 5C, and 5K, two-component developer comprising a plurality of colors and a carrier, for example, a two-component developer comprising yellow ("Y " hereinafter) and a carrier, a two-component developer comprising magenta ("M" hereinafter) and a carrier, a two-component developer comprising cyan ("C" hereinafter) and a carrier, and a two-component developer comprising black ("K" hereinafter) and a carrier, are fed respectively to electrostatic latent images on the photosensitive elements 4Y, 4M, 4C; and 4K to develop the electrostatic latent images.

A write device 6 as an exposure means is disposed above the photosensitive units 2Y, 2M, 2C, and 2K, while a double-side unit 7 is disposed below those photosensitive units. Further, below the double-side unit 7 are disposed paper feed cassettes 13 and 14 which can receive therein transfer mediums P of different sizes. On the left side of the apparatus body 1 is disposed an inverting unit 8, while on the right-hand side of the apparatus body 1 is disposed a manual paper feed tray 15 so that it can be opened and closed in the direction of arrow B. The fixing device 9 is positioned between the transfer belt 3 and the inverting unit 8. An inverting conveyance passage 10 is branched on a downstream side in a transfer medium conveying direction of the fixing device 9, and each transfer medium P, which is sheet-like, is conducted to a paper discharge tray 12 by means of paper feed rollers 11 disposed in the inverting conveyance passage 10, the paper discharge tray 12 being provided in an upper portion of the apparatus.

Figure 4:
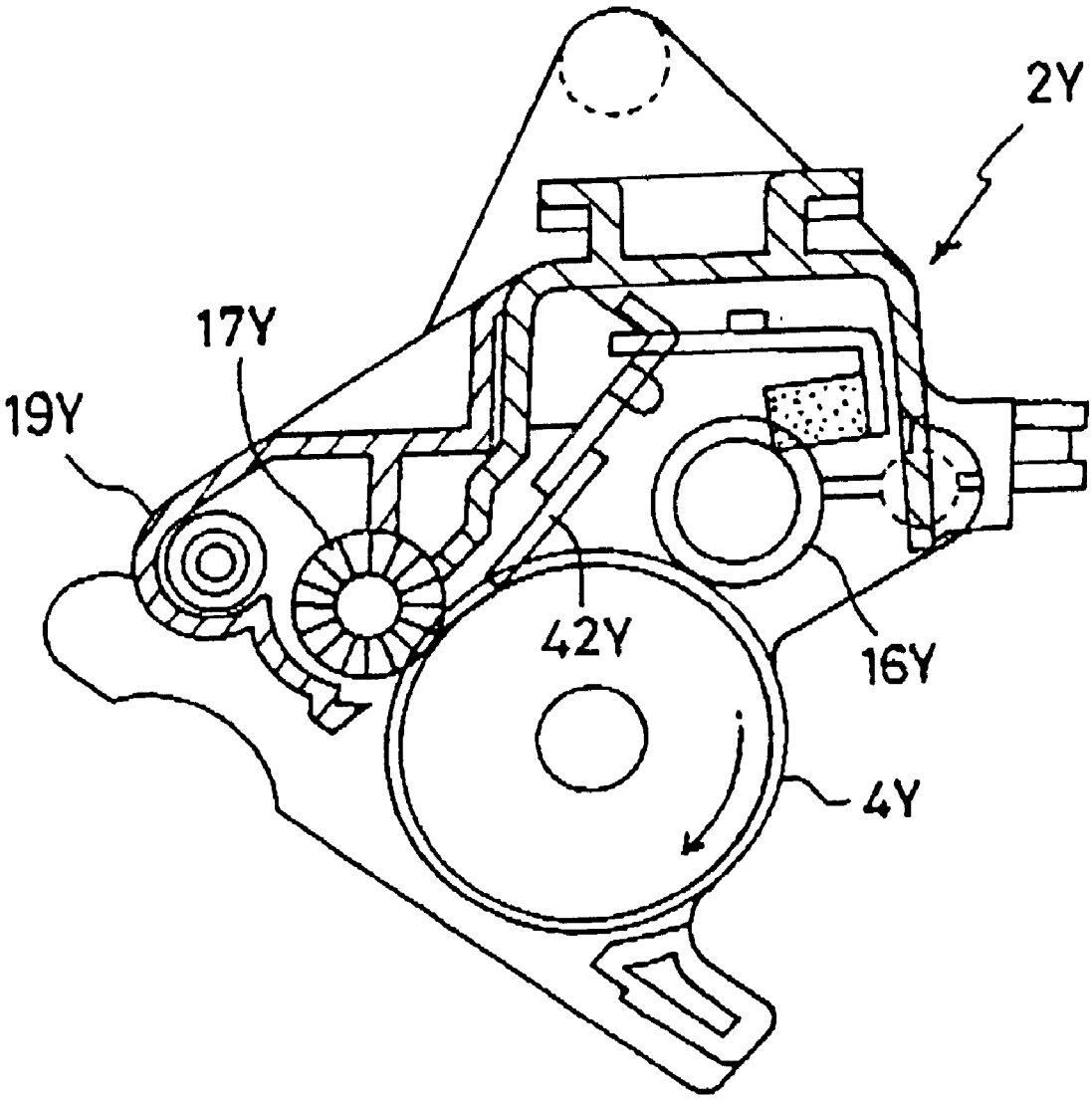
FIG. 4 is an enlarged diagram showing one mode of an image bearing unit having an image bearing member which is provided in the image formation apparatus shown in FIG. 2.

The photosensitive units 2Y, 2M, 2C, and 2K are for forming toner images of Y, M, C, and K colors on the photosensitive elements 4Y, 4M, 4C, and 4K, respectively. They have identical construction except the positions where they are disposed in the apparatus body 1. For example, as shown in FIG. 4, the photosensitive unit 2Y is constituted by an integral unit combination of the photosensitive element 4Y, a charging roller 16Y as a charging means adapted to be in contact with the photosensitive element 4Y, and a cleaning device 19Y which cleans the surface of the photosensitive element 4Y with a brush roller 17Y and a cleaning blade 18Y. The photosensitive unit 2Y thus constructed is detachably attached to the apparatus body 1. As to the constructions of the photosensitive unit 2M, 2C, and 2K, explanations thereof will be omitted.

Figure 3:
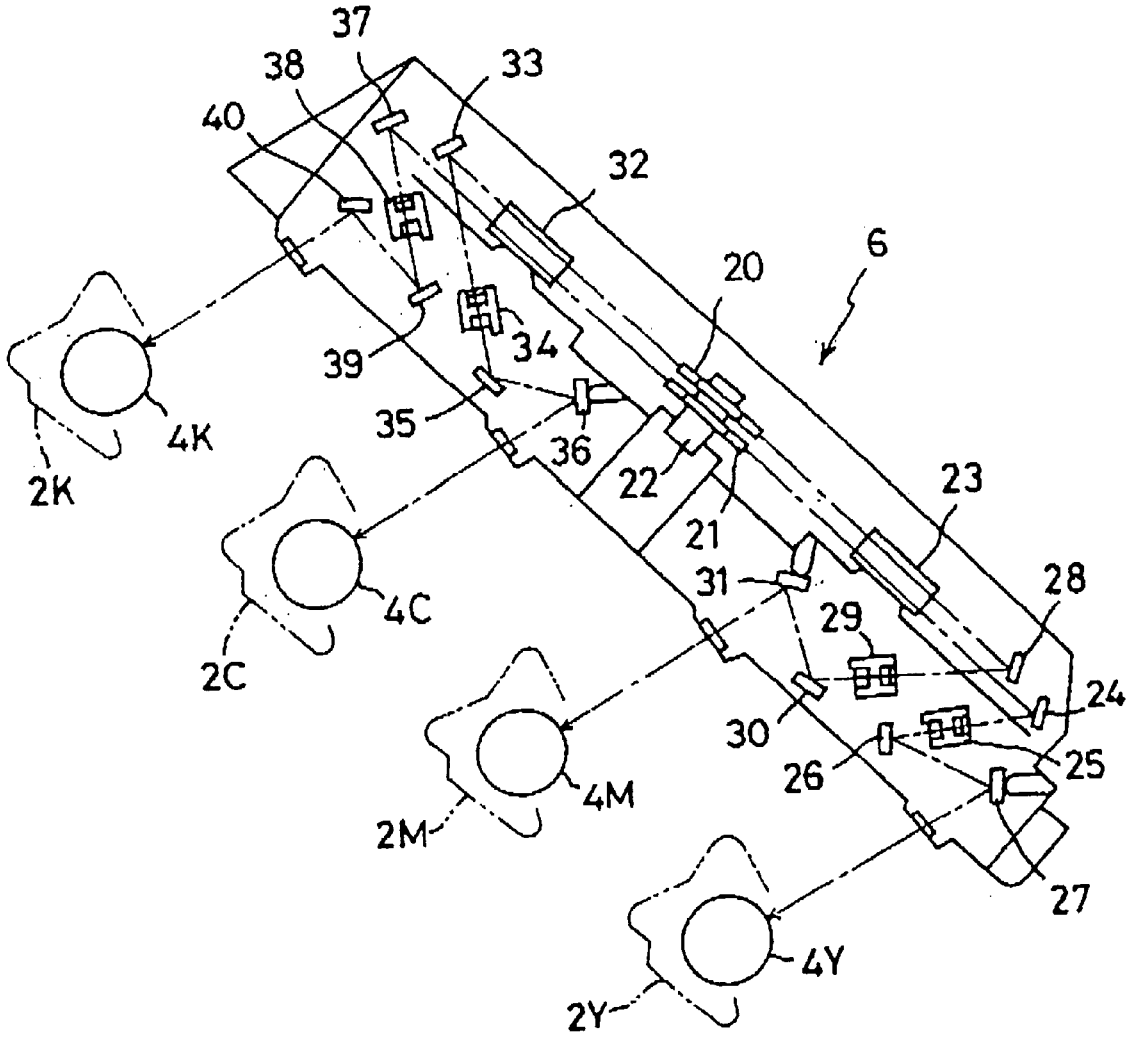
FIG. 3 is an enlarged diagram showing an entire construction of a write unit which is provided in the image formation apparatus shown in FIG. 2.

In the write device, as shown in FIG. 3, two rotary polygon mirrors 20 and 21 disposed coaxially are rotated by means of a polygon motor 22. The rotary polygon mirrors 20 and 21 reflect, in a right-left distributed manner, laser beam for Y modulated with Y image data and laser beam for Mn modulated with M image data both emitted from two laser diodes (not shown) as laser beam sources respectively, as well as laser beam for C modulated with C image data and laser beam for K modulated with K image data both emitted from two other laser diodes (not shown) as laser beam sources.

The laser beams for Y and M from the rotary polygon mirrors 20 and 21 respectively pass through a two-layer fθ lens 23. The laser beam for Y having passed through the fθ lens 23 is reflected by a mirror 24, then passes through an elongated WTL 25, and is thereafter radiated to the photosensitive element 4Y of the photosensitive unit 2Y through mirrors 26 and 27. The laser beam for M having passed through the fθ lens 23 is reflected by a mirror 28 and passes through an elongated WTL 29, then is radiated to the photosensitive element 4M of the photosensitive unit 2M through mirrors 30 and 31.

The laser beams for C and K reflected from the rotary polygon mirrors 20 and 21 pass through a two-layer fθ lens 32. The laser beam for C having passed through the fθ lens 32 is reflected by a mirror 33 and passes through an elongated WTL 34, then is radiated to the photosensitive element 4C of the photosensitive unit 2C through mirrors 34 and 36. The laser beam for K having passed through the fθ lens 32 is reflected by a mirror 37 and passes through an elongated WTL 38, then is radiated to the photosensitive element 4K of the photosensitive unit 2K through mirrors 39 and 40.

As shown in FIG. 2, the double-side unit 7 is provided with a pair of conveyance guides 41 and 42 and a plurality of conveyance roller pairs 43. In a double-side image forming mode for forming images on both sides of the transfer medium P, an image is first formed on one side of the transfer medium, then the transfer medium P is conveyed to an inverting conveyance passage 44 of the inverting unit 8 and is conveyed in a switch-back manner, whereby the transfer medium P is turned upside down, and the double-side unit 7 receives the transfer medium P and re-conveys it to transfer sections formed between the photosensitive elements 4Y, 4M, 4C, 4K and the transfer belt 3.

The inverting unit 8 includes a plurality of conveyance rollers and conveyance guide plates, and has a function of turning upside down the transfer medium with an image formed on one side thereof in the double-side image forming mode and sending it out to the double-side unit 7, a function of discharging the transfer medium after image formation out of the apparatus while leaving its direction intact, and a function of discharging the transfer medium out of the apparatus in an inverted state of its surface and back. In a paper feed section where the paper feed cassettes 13 and 14 are disposed, there are provided paper separate feed portions 45 and 46 for separating and feeding transfer media P on the paper feed cassettes 13 and 14 one by one. Inside the transfer belt 3 are disposed transfer brushes 47, 48, 49, and 50 as transfer means so as to oppose to the photosensitive elements 4Y, 4M, 4C, and 4K, respectively.

In this embodiment, when image formation is instructed by an operating section (not shown), the photosensitive elements 4Y, 4M, 4C, and 4K are driven to rotate clockwise by a drive source (not shown) in FIG. 2. A charging bias from a power supply (not shown) is applied to the charging rollers 16Y in the photosensitive units 2Y, 2M, 2C, and 2K so as to electrically charge the photosensitive elements 4Y, 4M, 4C, and 4K uniformly. After thus uniformly charged by the charging rollers 16Y, the photosensitive elements 4Y, 4M, 4C, and 4K are exposed respectively to laser beams modulated by image data of Y, M, C, and K colors and electrostatic latent images are formed on their surfaces. The electrostatic latent images thus formed on the photosensitive elements 4Y, 4M, 4C, and 4K are developed into toner images of Y, M, C, and K colors by the developing units 5Y, 5M, 5C, and 5K, respectively.

One transfer medium P is separated from a selected one of the paper feed cassettes 13 and 14 and is fed to a resist roller 51 disposed on the paper feed section side with respect to the photosensitive unit 2Y. In this embodiment, the manual paper feed tray is disposed on the right-hand side of the apparatus body 1 enabling to feed a transfer medium to the resist roller 51 also from the manual paper feed tray 15. The resist roller 51 sends out each transfer medium onto the transfer belt 3 at a timing at which the front end of the transfer medium coincides with the toner image on each of the photosensitive elements 4Y, 4M, 4C, and 4K. The transfer medium thus sent out is electrostatically attracted to the transfer belt 3 which is electrically charged by a paper attracting roller 52, and is conveyed to each transfer section.

While the transfer medium is thus conveyed and passes through the transfer sections successively, toner images of Y, M, C, and K colors on the photosensitive elements 4Y, 4M, 4C, and 4K are successively transferred overlappedly onto the transfer medium by transfer brushes 47 to 50, whereby forming a four-color overlapped, full-color toner image. The full-color toner image thus formed on the transfer medium is then fixed by the fixing device 9 and is thereafter discharged invertedly to the paper discharge tray 12 through a paper discharge passage determined in accordance with a designated mode, or goes straight ahead from the fixing device 9, passes through the interior of the inverting unit 8 and is discharged straight.

When the double-side image forming mode is selected in the image formation apparatus, a toner image is formed on one side of the transfer medium P and is fixed by the fixing device 9, then the transfer medium is fed into the inverting conveyance passage 44 formed within the inverting unit 8. After being switch-backed in the inverting conveyance passage 44, the transfer medium P is conveyed to the double-side unit 7, from which it is again fed, followed by image formation on the back thereof in the same way as in the image formation on the surface and subsequent discharge.

The above image forming operations are performed when the four-color overlapped full-color mode is selected by an operating section (not shown). If a three-color overlapped full-color mode is selected by the operating section, the formation of a K toner image is omitted and a full-color image is formed on the transfer medium by overlapping toner images of three Y, M, and C colors. Further, if a black-and-white image forming mode is selected by the operating section, there is performed only the formation of a K toner image and a black-and-white image is formed on the transfer medium.

Figure 5:
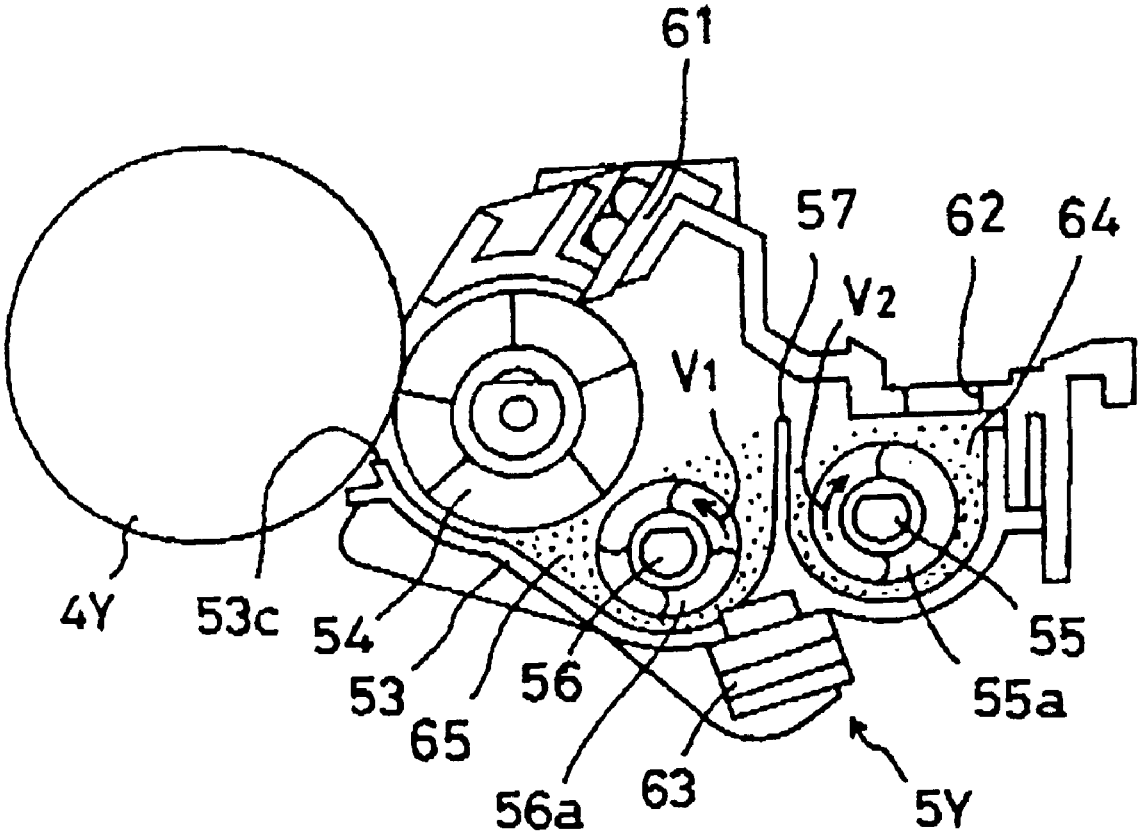
FIG. 5 is an enlarged diagram showing a schematic construction of the developer as seen in a developer conveying direction.

The developing units 5Y, 5M, 5C, and 5K are of an identical construction except that respective toner colors are different. Therefore, explanation will be given on the construction of the developing unit 5Y as an example. FIG. 5 illustrates the developing unit 5Y viewed from the developer conveying side and FIG. 1 is a partially broken-away view of the developing unit 5Y viewed from above.

Figure 1:
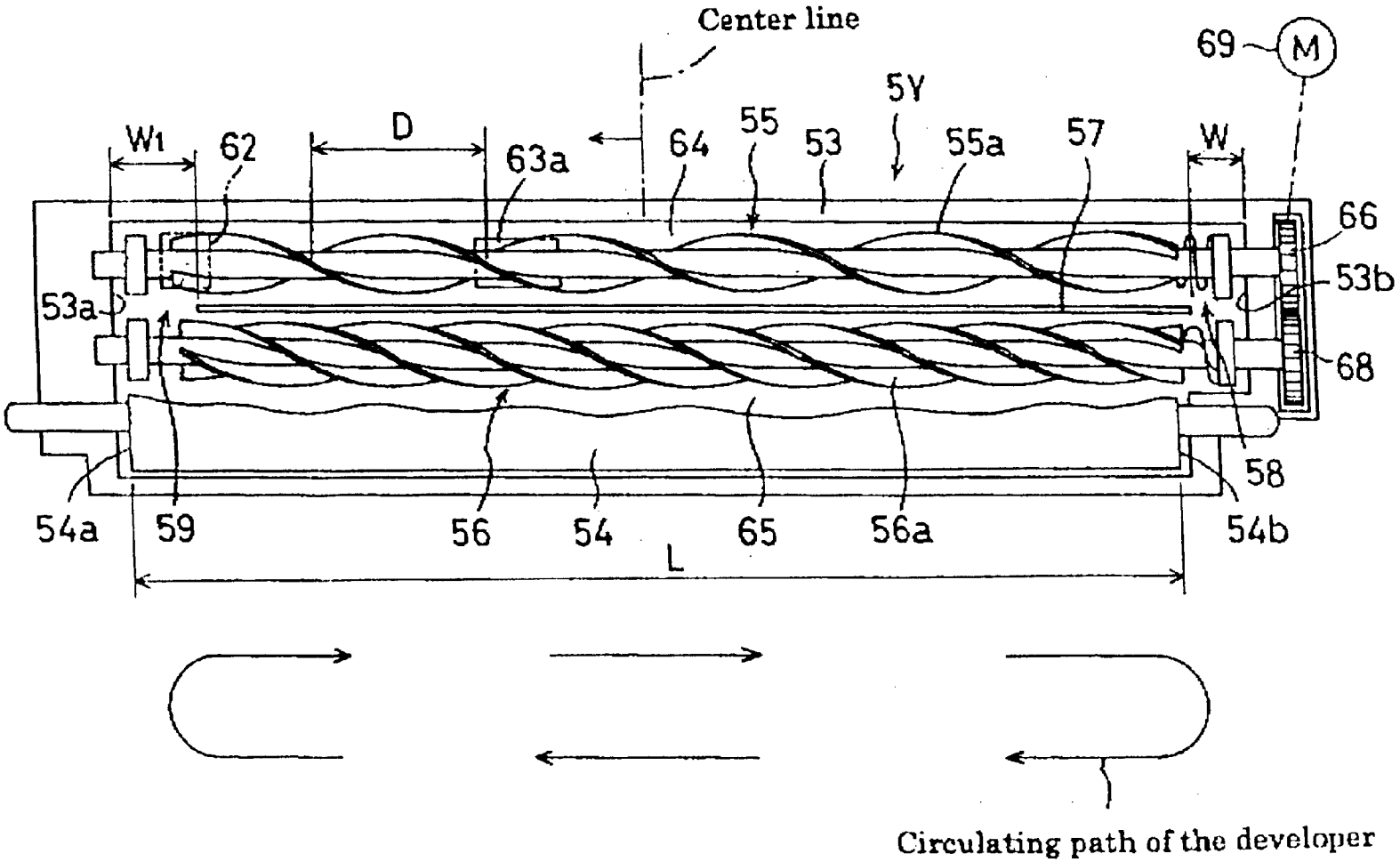
FIG. 1 is a plan view showing the construction of a developing apparatus according to the present invention.

In FIGS. 1 and 5, the developing unit 5Y includes a development case 53 which contains a two-component developer consisting of a Y toner and a carrier, a developing sleeve 54 as a developer carrier disposed within the development case 53 so as to be opposed to the photosensitive element 4Y through an opening 53*c* of the development case 53, and multiple-thread screw members 55 and 56 disposed within the development case 53, the screw members 55 and 56 serving as agitating members for conveying the developer under agitation.

The interior of the development case 53 is divided by a partition wall 57 into a first space 65 positioned on the developer supply side for the photosensitive element 4Y and a second space 64 which receives a replenishing toner supplied from a supply port 62. The screw members 56 and 55 are disposed in the spaces 65 and 64, respectively, and are rotatably supported by bearings (not shown) disposed in the development case 53. The developing sleeve 54 is also rotatably supported in the development case 53 through a bearing (not shown). The developing sleeve 54 rotates with a rotational drive force transmitted thereto from drive means (not shown).

As shown in FIG. 1, the screw members 55 and 56 extend in the width direction of the transfer medium P and are disposed in parallel to each other. Gears 66 and 68 having an identical number of teeth are attached to one end of the screw member 55 and to one end of the screw member 56, respectively, so as to mesh with each other. In this embodiment, a rotational drive force is transmitted from a drive motor 69 to the gear 66, whereby the screw members 55 and 66 are rotated in directions opposite to each other. In FIG. 1, the screw member 55 rotates in a direction to convey the developer from left to right, while the screw member 56 rotates in a direction to convey the developer from right to left.

The screw member 56 as a first agitating member disposed in the space 65 has screw portions 56*a* corresponding to n threads ($n \geqq 2$), while the screw member 55 as a second agitating member disposed in the space 64 has screw portions 55*a* corresponding to (n−x) threads ($x \geqq 0$). In this embodiment, the screw member 56 is a four-thread screw and the screw member 55 is a two-thread screw.

The screw portions 55*a* and 56*a* as thread portions are formed to be continuous respectively in the extending directions of the screw members 55 and 56 and to have an identical screw pitch D of each thread.

A delivery portion 59 for delivery of developer from the space 65 to the space 64 is formed between one end of the partition wall 57 and an inner side face 53*a* of the development case 53, while a delivery portion 58 for delivery of developer from the space 64 to the space 65 is formed between the other end of the partition wall 57 and an inner side face 53*b* of the development case 53. The delivery portion 58 is formed so as to have width W which is narrower than the width $W_1$ of the delivery portion 59. The end portion of the development case 53 where the delivery portion 58 is formed protrudes out of an image forming area L on the photosensitive element formed between the end faces 54*a* and 54*b* of the developing sleeve 54, 50 that the delivery portion 58 is positioned outside the image forming area L.

A T sensor 63 as toner concentration detecting means is attached to the development case 53, so as to detect and output a toner concentration in the developer. As shown in FIG. 1, the T sensor 63 has a detection surface 63*a* which faces the interior of the space 64, and is disposed closer to the delivery portion 59 than the delivery portion 58 with respect to a center line of the image forming area L.

The operation of the developing unit 5Y having the aforementioned construction will be described below in connection with the conveyance of the developer.

When the screw members 55 and 56 are rotated at a constant speed, the two-component developer present in the development case 53 is conveyed from left to right in FIG. 1 while being agitated and is fed from the delivery portion 58 into the space 65 in which the convey screw 56 is disposed. The two-component developer fed from the delivery portion 58 into the space 65 is agitated and conveyed leftwards in FIG. 1 by the screw 56, then is fed from the delivery portion 59 into the space 64, in which it is again agitated and conveyed rightwards by the screw 55. Since the developer is thus agitated and is at the same time conveyed while circulating through the developing unit 5Y, the Y toner and the carrier are charged by friction caused by agitation.

The convey screw 56 feeds a portion of the developer to the developing sleeve 54, which in turn carries and conveys the developer magnetically. As shown in FIG. 5, the height (amount) of the developer present on the developing sleeve 54 is regulated by a regulation member 61 disposed in the development case 53. The electrostatic latent image on the photosensitive element 4Y is developed by the Y toner present on the developing sleeve 54 to form a Y toner image.

When the toner concentration (toner-carrier ratio) of the developer contained in the development case 53 becomes a predetermined value, Y toner is replenished from the toner supply port 62 into the space 64 side in the development case 53. The Y toner thus replenished is mixed with the developer with agitation by the screw member 55.

In this embodiment, the screw member 55 has a smaller number of screw portions 56*a* as threads than the screw member 56, which reduces its volume in the space 64. For this, even in case of using a multi-thread screw as an agitating member, the bulk (height) of the developer is suppressed, which in turn reduces the amount of the developer loaded into the developing apparatus 5Y As a result, it is possible to ensure a required amount of the developer fed into the space 65. Besides, since the bulk (height) of the developer is suppressed, the screw member 55 is not buried in the developer and there is not formed any conveying force-free area. Consequently, a decrease of the developer conveying speed is prevented and it is possible to suppress the developer staying phenomenon in the vicinity of the delivery portion 58.

As shown in FIG. 1, since the delivery portion 58 is positioned out of the image forming area L, the position for delivering the developer from the space 64 to the space 65 is dislocated from the image forming area L. Accordingly, even if an excessive amount of developer is fed from the delivery portion 58 into the space 65, there is no delivery of the developer in the image forming area L. Consequently, as shown in FIG. 65, there is no longer any partial supply of the developer to the developing sleeve 54 or leakage of the developer out of the opening 53*c* positioned in the space 65.

In the space 65 serving as a toner supply side for the photosensitive element there is disposed the screw member 56 as an agitating member having a greater number of screw portions 56*a* than the screw member 66, which enables to set the bulk (height) of the developer in the space 65 at a higher position. Consequently, a sufficient amount of the developer can be fed to the developing sleeve 54, which prevents generation of a screw trace.

The T sensor 63 is disposed closer to the delivery portion 59 as the toner supply port 62 side than the delivery portion 58 with respect to the center line of the image forming area L. Therefore, even if there is a change in the way of staying of the developer on the delivery portion 58, such a change can be made less influential, which enables to output stable detection information and enhance the toner concentration detecting accuracy.

Figure 6:
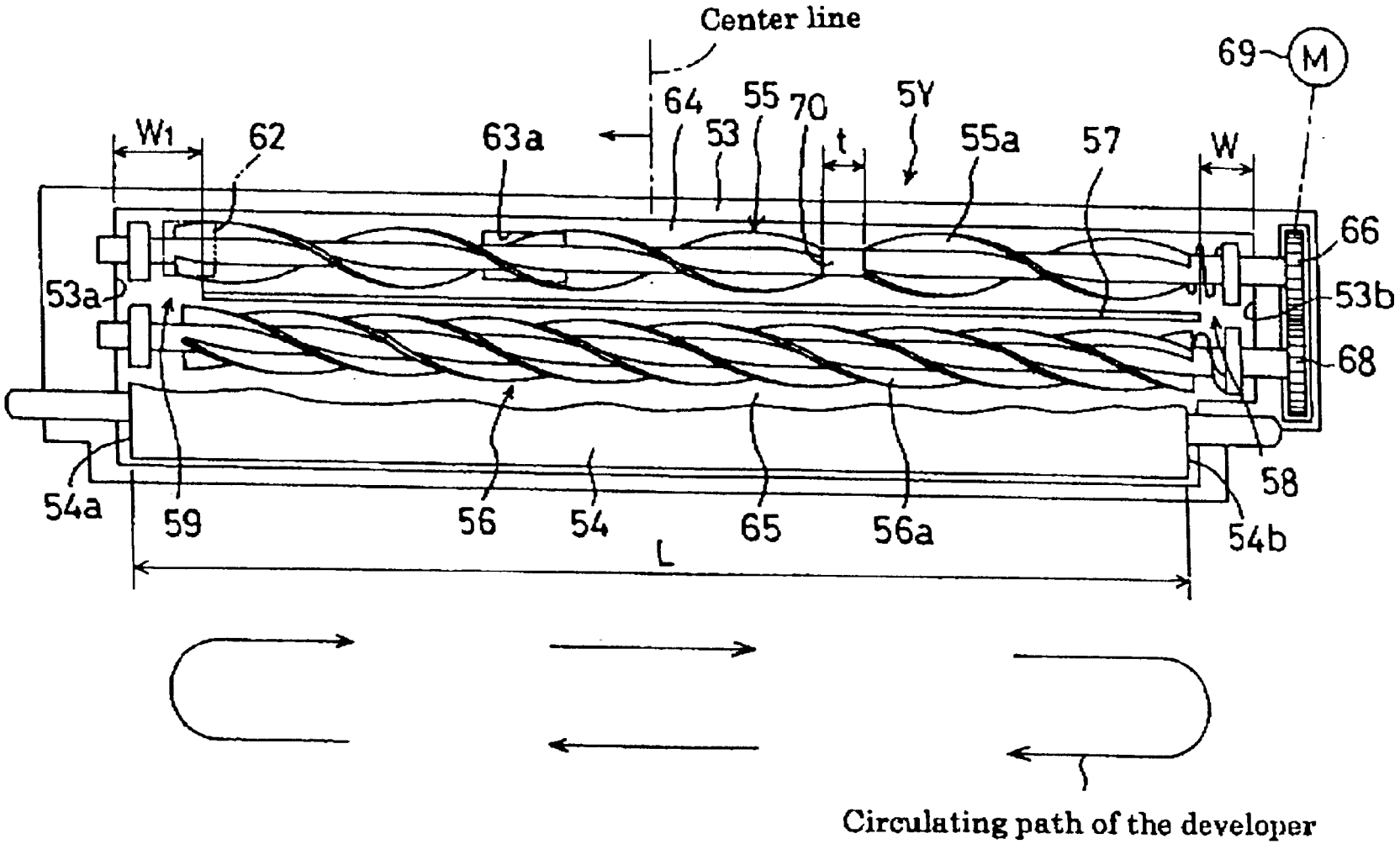
FIG. 6 is a plan view showing the construction of a developing apparatus according to the present invention having a second agitating member which is provided with a non-screw portion.

FIG. 6 shows a non-screw portion 70 not having the screw portions 55*a* provided at a portion of the screw member 55 shown in FIG. 1 which portion is positioned in a predetermined interval t in the developer conveying direction. When this non-screw portion 70 is provided the developer conveying force is suppressed to lower the developer conveying capacity of the screw member 55. This in turn suppresses the developer staying phenomenon in the vicinity of the delivery portion 58.

In this modification, the non-screw portion 70 is provided on the screw member 55 to prevent staying of the developer near the delivery portion 58 and the developer conveying capacity of the screw member 55 is reduced. It is also possible to adopt the following methods for the same purpose.

For example, in FIGS. 1 and 6, gears adjusted to a gear ratio of $V_1>V_2$ are used as the gears 66 and 68, or pulleys different in speed change ratio are used instead of the gears 66 and 68, and are mounted on end portions of the screw members 55 and 56, respectively. According to this construction, the amount of the developer conveyed per unit time by the screw member 55 can be made smaller than the amount conveyed per unit time by the screw member 56, thereby enabling to suppress the stay of the developer in the vicinity of the delivery portion 58.

As shown in FIG. 1, if the screw pitch D of the screw member 55 is set smaller, the amount of the developer conveyed per unit time decreases. Thus, it is possible to reduce the developer conveying capacity of the screw member 55 without changing the drive system or controlling the speed thereof.

As set forth above, according to the present invention, by setting a smaller number of threads of the second agitating member in the second space than that of the first agitating member in the first space, it is possible to reduce the volume of the second agitating member in the second space to suppress the bulk (height) of the developer in the second space while ensuring a required bulk (height) of the developer in the first space, which significantly reduces occurrence of screw pitch traces and defective development due to a deficient supply of the developer.

According to the present invention, when the second delivery portion is provided out of the image forming area of the image bearing unit, the developer delivery position from the second space to the first space is positioned out of the image forming area of the image bearing unit. Accordingly, delivery of the developer is no longer performed in the image forming area and thus it is possible to prevent leakage of the developer out of the apparatus.

According to the present invention, by providing a non-screw portion at a portion of the second agitating member positioned in a predetermined interval in the developer conveying direction, or by setting the rotation speed $V_1$ of the first agitating member and the rotation speed $V_2$ of the second agitating member so as to satisfy the relation of $V_1>V_2$, or by reducing the screw pitch of the second agitating member, the developer conveying capacity of the second agitating member is reduced. This suppresses the staying of the developer near the second delivery portion decreases and there is no longer any excessive feed of the developer into the first space thus preventing leakage of the developer out of the apparatus.

Further, according to the present invention, the toner concentration detecting means is disposed closer to the first delivery portion than to the second delivery portion with respect to the center of the image forming area. Accordingly, even if there occurs a change in the way of staying of the developer on the second delivery portion side, the change is less influential. Thus, even if there occurs a change in the way of staying of the developer in the developing apparatus, the toner concentration can be detected accurately.

What is claimed is:

1. A developing apparatus comprising:

a case divided into a first space located at a developer supply side for supplying the developer to an image bearing member and a second space for receiving a replenishing toner; and a first and a second agitating member arranged in the first and the second spaces in such a manner that the first and the second agitating members are positioned parallel to each other and are driven to rotate to agitate and convey the developer, wherein the first agitating member arranged in the first space is a screw member having n threads (n>2), and the second agitating member arranged in the second space is a screw member having (n−x) threads (x≧0), and wherein a non-screw portion is formed at a portion between the threads of the second agitating member located at a predetermined interval in a convey direction of the developer conveyed by the second agitating member.

2. The developing apparatus as claimed in claim 1, further comprising:

a first delivery portion for feeding the developer from the first space into the second space; and a second delivery portion for feeding the developer from the second space into the first space, said secondary delivery portion being positioned outside an image formation area of the image bearing member.

3. The developing apparatus as claimed in claim 2, wherein a rotation speed of the first agitating member is set greater than a rotation speed $V_2$ of the second agitating member.

4. The developing apparatus as claimed in claim 2, wherein the second agitating member has a reduced screw pitch.

5. The developing apparatus as claimed in claim 2, further comprising:

a toner concentration detector arranged at a position closer to the first delivery portion than to the second delivery portion from a center of an image formation area and having a detection surface facing the interior of the second space.

6. The developing apparatus as claimed in claim 1, wherein a rotation speed $V_1$ of the first agitating member is set greater than a rotation speed $V_2$ of the second agitating member.

7. The developing apparatus as claimed in claim 6, further comprising:

a toner concentration detector arranged at a position closer to the first delivery portion than to the second delivery portion from a center of an image formation area and having a detection surface facing the interior of the second space.

8. The developing apparatus as claimed in claim 1, wherein the second agitating member has a reduced screw pitch.

9. The developing apparatus as claimed in claim 8, further comprising:

a toner concentration detector arranged at a position closer to the first delivery portion than to the second delivery portion from a center of an image formation area and having a detection surface facing the interior of the second space.

10. The developing apparatus as claimed in claim 1, further comprising toner concentration detector arranged at a position closer to the first delivery portion than to the second delivery portion from a center of an image formation area and having a detection surface facing the interior of the second space.

11. An image formation apparatus comprising:

an image bearing member, and a developer device for supplying developer to an electrostatic latent image formed on the image bearing member, wherein the developer device includes a developing apparatus includes:

a case divided into a first space located at a developer supply side for supplying the developer to an image bearing member and a second space for receiving a replenishing toner; and a first and a second agitating member arranged in the first and the second spaces in such a manner that the first and the second agitating members are positioned parallel to each other and are driven to rotate to agitate and convey the developer, wherein the first agitating member arranged in the first space is a screw member having n threads (n>2), and the second agitating member arranged in the second space is a screw member having (n−x) threads (x≧0), and wherein a non-screw portion is formed at a portion between the threads of the second agitating member located at a predetermined interval in the convey direction of the developer conveyed by the second agitating member.

* * * * *